United States Patent [19]

Mark

[11] 4,441,889

[45] Apr. 10, 1984

[54] COAL-AQUEOUS MIXTURES

[75] Inventor: Seymour Mark, Northampton, Pa.

[73] Assignee: Gulf & Western Industries, Inc., New York, N.Y.

[21] Appl. No.: 416,606

[22] Filed: Sep. 10, 1982

Related U.S. Application Data

[63] Continuation-in-part of Ser. No. 230,062, Jan. 29, 1981, abandoned.

[51] Int. Cl.[3] ..... C10L 1/32

[52] U.S. Cl. ..... 44/51; 44/71; 252/351; 252/Dig. I

[58] Field of Search ..... 44/51, 77; 252/351, 252/DIG. 1

[56] References Cited

U.S. PATENT DOCUMENTS

| | | |
|---|---|---|
| 3,210,168 | 10/1965 | Morway . |
| 3,524,682 | 8/1970 | Booth . |
| 3,620,698 | 11/1971 | Schlinger et al. . |
| 3,762,887 | 10/1973 | Clancey et al. . |
| 3,764,547 | 10/1973 | Schlinger et al. . |
| 3,996,026 | 12/1976 | Cole . |
| 4,088,453 | 5/1978 | Wiese et al. . |
| 4,104,035 | 8/1978 | Cole et al. . |
| 4,217,109 | 8/1980 | Siwersson et al. . |
| 4,242,098 | 12/1980 | Braun et al. . |
| 4,251,229 | 2/1981 | Naka et al. . |
| 4,305,729 | 12/1981 | Stearns . |
| 4,330,301 | 5/1982 | Yamamura et al. . |
| 4,358,293 | 11/1982 | Mark ..... 44/51 |

FOREIGN PATENT DOCUMENTS

| | | |
|---|---|---|
| 50412 | 4/1982 | European Pat. Off. . |
| WO81/01152 | 4/1981 | PCT Int'l Appl. . |
| 1523193 | 8/1978 | United Kingdom . |

OTHER PUBLICATIONS

Development and Evaluation of Highly Loaded Coal Slurries—2nd International Symposium of Coal-Oil Mixture Combustion Nov. 27-29, 1979.

*Primary Examiner*—Jacqueline V. Howard
*Attorney, Agent, or Firm*—Scully, Scott, Murphy & Presser

[57] ABSTRACT

Coal-aqueous mixture having high solids content and excellent stability are provided by an improved process involving selective mixing and other conditions.

23 Claims, No Drawings

COAL-AQUEOUS MIXTURES

CROSS-REFERENCE TO RELATED APPLICATIONS

This application is a continuation-in-part of U.S. application Ser. No. 230,062 filed Jan. 29, 1981, now abandoned, the entire contents of which are incorporated by reference herein.

BACKGROUND OF THE INVENTION

The present invention relates to the dispersion of carbonaceous materials and more particularly to coal-aqueous coal mixtures.

Coal as an energy source is in abundant supply. It is estimated that in the United States there is more energy avaiable in coal then in petroleum, natural gas, oil shale and tar sands combined. The substitution of coal for natural gas and oil on a large scale would therefore seem a ready-made solution to our energy problems. Unfortunately, however, unlike oil and gas consumption, coal use is limited not by reserves or production capacity but rather by the extraordinary industrial and regulatory difficulties of burning it in a convenient, efficient and environmentally acceptable manner.

A number of techniques are being explored to provide coal as a more useful energy source. One such technique employs gasification methods such as destructive distillation, to effect the conversion of coal to a low or medium Btu gas. In another approach, high pressure hydrogenation is utilized to liquefy coal to make it more suited for transport, burning and the like.

Another technique suggested, and the one to which the present invention relates, is the technique whereby solid coal particles are dispersed in a fluid carrier medium, such as fuel oil or water to form coal-aqueous or coal-oil mixtures.

Coal-oil and coal-aqueous mixtures, however, are distinct systems, each having its own difficulties of formulation. For example, while coal and oil are relatively compatible, coal and water are not. Thus, unlike in the formulation of coal-oil admixtures, in the formulation of coal-aqueous admixtures, the initial dispersing of the coal in the continuous water phase, especially large amounts of coal, represents a challenging obstacle. Moreover, after dispersion, stabilizing, i.e. keeping the coal from settling out of the water phase, must be also achieved.

Such coal mixtures offer considerable advantages. They are more readily transported then dry solid coal, are more easily stored and are less subject to the risks of explosion by spontaneous ignition, the latter being a significant factor in handling coal. In addition, providing coal in a fluid form can permit its burning in apparatus normally used for burning fuel oil. This can greatly facilitate the transition from fuel oil to coal as a primary energy source, another highly desirable result.

Various coal-oil and coal-aqueous mixtures have been described in the literature. For example, British Pat. No. 1,523,193 discloses a mixture comprised of fuel oil and from 15 to 55% by weight of finely ground coal particles reduced in particle size to 10 microns or finer. The effort required to grind coal to such fine sizes, however, makes the process less economically attractive. Moreover, the use of fuel oil as a carrier medium negates the requirement of lessening our dependence upon fuel oil.

U.S. Pat. No. 4,251,229 is an example of coal-oil mixtures stabilized with high molecular weight adducts of alkylene oxide and an alcohol, an amine, a carboxylic acid or phenol having at least three active hydrogens. In this patent, oil is the continuous carrier phase and accordingly, the stabilization of the coal, as emphasized repeatedly therein, in the continuous oil phase, is essentially the only concern.

U.S. Pat. No. 4,242,098 discloses aqueous coal slurry compositions containing water soluble polymers, which are thickeners, such as xanthan gum, hydroxypropyl guar gum or poly(ethylene oxide) having a molecular weight over 100,000.

In U.S. Pat. No. 3,762,887, there is disclosed a dispersion of coal in an aqueous medium wherein the coal is ground to a defined array of particle sizes, a substantial portion of which being about 325 mesh Tyler Standard screen or even finer. Here again, substantial and selective grinding of the coal is required.

U.S. Pat. No. 4,217,109 discloses a technique for cleaning and dispersing coal in water utilizing dispersing agents which by selective adsorption impart differential electrical charges to the carbon particles and the impurities. The dispersing agents taught are polyelectrolytes, such as alkali metal and ammonium salts of polycarboxylic acids and polyphosphates.

The article titled "Development and Evaluation of Highly-Loaded Coal Slurries" published in the *2nd International Symposium on Coal-Oil Mixture Combustion,* Nov. 27–29, 1979, teaches coal-aqueous mixtures using coal of bimodal particle size distributions and containing modified starches, biocides and a wetting agent such as TRITON X, an octylphenoxy (ethyleneoxy) ethanol surfactant of low molecular weight.

And according to U.S. Pat. No. 3,617,095 a still further method is mentioned in the literature for forming emulsions of bulk solids by admixing the solid, such as coal, with water and oil in the presence of an oxyalkylated octyl phenol emulsifying agent.

Finally, a number of further patents disclose mechanical treatments and dispersants for providing coal in a carrier medium. See, e.g., U.S. Pat. Nos. 4,088,453; 4,104,035; 3,620,698; 3,764,547; 3,996,026; 3,210,168; 3,524,682; 4,330,301; 4,305,729; European Patent No. 0 050 412 and PCT International Application No. WO 81-01152.

While the art has attempted to provide coal in dispersed fluid form, as evidenced by the above-described procedures, there still remains the need for improving these methods in order to provide coal mixtures without undue mechanical or chemical treatment. It would be highly desirable to provide coal in aqueous mixture form wherein only minor amounts of additive materials are needed to disperse the coal to high solids concentrations by 70% by weight, or higher. It would be further desirable to provide coal-aqueous mixtures wherein the coal is precleaned of impurities so that the resultant mixtures are clean burning or relatively clean burning and thus more environmentally acceptable.

SUMMARY OF THE INVENTION

Accordingly, it is one object of the present invention to provide dispersions of coal in a carrier medium.

It is another object of the present invention to provide coal-aqueous mixtures of high coal solids content.

It is a further object of the invention to provide coal-aqueous mixtures of high solids content wherein only minor amounts of additive materials are needed and little mechanical treatment is required.

It is a still further object of the invention to provide coal-aqueous mixtures wherein the dispersed coal is precleaned of impurities so that the resultant mixtures are clean-burning or relatively clean-burning.

A further object of the invention is to provide suitable methods for forming coal-aqueous mixtures.

These and other objects will become apparent from the accompanying detailed description.

DETAILED DECRIPTION OF THE INVENTION

U.S. Ser. No. 230,062 filed Jan. 29, 1981, incorporated herein by reference, discloses the surprising discovery that certain polyalkyleneoxide nonionic surfactants are excellent additives for forming coal-aqueous mixtures having high coal solids concentrations. It is also disclosed therein that polyalkyleneoxide nonionic surfactants of high molecular weight having a hydrophobic portion and a hydrophilic portion, the hydrophilic portion being comprised of at least about 100 ethylene oxide repeating units, provide coal-water dispersions having very high coal solids concentrations of about 70% by weight coal, or higher, when the surfactant is present in an amount sufficient to disperse the particulate coal in water. The resultant mixtures are free-flowing and are adapted to provide coal in a form ready for transport, storage and clean-burning. Surprisingly, the surfactants employed can differ in chemical structure so long as they are of the selected type, are of sufficient molecular weight and are comprised of at least about 100 units of ethylene oxide.

It has now been further surprisingly discovered that by employing certain processing conditions, hereinafter described in detail, in the preparation of the coal-aqueous slurries disclosed in the afore-mentioned U.S. application Ser. No. 230,062, even more improved coal-aqueous slurries are provided. For example, the coal slurries prepared in accordance with the present invention are characterized by high solids content, excellent long term storage stability and other advantages which will become apparent hereinafter.

The coal-aqueous slurries of the present invention are comprised of coal or other carbonaceous material as the dispersed solid; water as the carrier medium, and a polyalkyleneoxide nonionic surfactant, as further described herein.

As used herein "polyalkyleneoxide nonionic surfactant" connotes all compositions, compounds, mixtures, polymers, etc. having in whole or in part an alkylene oxide repeating unit of the structure:

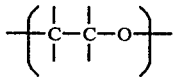

and having a hydrophobic portion and a hydrophilic portion and which does not dissociate or ionize in solution. These surfactants have a polymeric portion comprised of repeating units of ethylene oxide of the general formula:

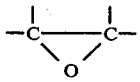

Moreover, the polyalkyleneoxide nonionic surfactant compositions employed in this invention are of high molecular weight, i.e., from 4,000 or higher, depending on the particular surfactant employed, are hydrophilic and are comprised of at least about 100 repeating units of the ethylene oxide monomer. In addition, the surfactants utilized have a hydrophobic portion and a hydrophilic portion and are nonionic. Being nonionic, these compositions are generally not subject to ionization in aqueous solutions of acid or alkali.

Suitable hydrophilic polyalkyleneoxide nonionic surfactants for use in this invention are the commercially available glycol ethers of alkyl phenols of the following general formula I:

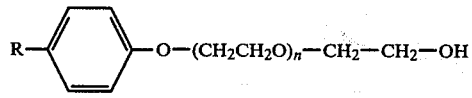

wherein R is substituted or unsubstituted alkyl of from 1 to 18 carbon atoms, preferably 9 carbon atoms; substituted or unsubstituted aryl, or an amino group and n is an integer of at least about 100.

These nonionic surfactants are available in a wide array of molecular weights depending primarily on the valve of "n", i.e., the number of ethylene oxide repeating units. Surprisingly, it has been found that these surfactants of a high molecular weight of about 4,000 or higher wherein "n" is at least 100, or higher are particularly effective as dispersants for forming coal-aqueous mixtures to high coal solids concentration requiring little if any further additives, etc., to form highly flowable liquids.

Procedures for the preparation of the glycol ethers of formula I are well known and are described, for example, in U.S. Pat. Nos. 2,213,477 and 2,496,582, which disclosures are incorporated herein by reference. Generally, the production of these compositions involves the condensation of substituted phenols with molar proportions of ethylene oxide monomer.

Thus, polyalkyleneoxide nonionic surfactants suitable for use in the invention include the glycol ethers of alkylated phenols having a molecular weight of at least about 4,000 of the general formula:

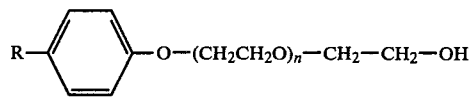

wherein R is substituted or unsubstituted alkyl of from 1 to 18 carbon atoms, preferably 9 carbon atoms; substituted or unsubstituted aryl, or an amino group, and n is an integer of at least about 100. The substituents of the alkyl and aryl radicals can include halogen, hydroxy, and the like.

Other suitable nonionic surfactants are the poly(oxyethylene)-poly(oxypropylene)-poly(oxyethylene) or, as otherwise described, propoxylated, ethoxylated propylene glycol nonionic surfactant block polymers having a molecular weight of at least about 6,000 of the general formula:

$$HO(CH_2CH_2O)_a]CH(CH_3)CH_2O]_b(CH_2CH_2O)_cH$$

wherein a, b and c are whole integers and wherein a and c total at least about 100.

Still other polyalkyleneoxide nonionic surfactants suitable for use in the invention are the block polymers of ethylene and propylene oxide derived from nitrogen-containing compositions such as ethylene diamine and having a molecular weight of at least about 14,000 of the general formula:

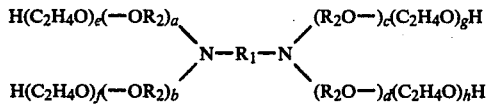

wherein $R_1$ is an alkylene radical having 2 to 5 carbon atoms, preferably 2; $R_2$ is alkylene radical having 3 to 5 carbon atoms, preferably 3; a, b, c, d, e, f, g and h are whole integers; and e, f, g and h total at least about 100.

The coal-aqueous mixture compositions of the invention herein are characterized by having a high coal solids content and a relatively low viscosity of about 2,000 to 6,000 centipoise(cP) or lower as measured, e.g., in a Brookfield viscometer, model #RVT, fitted with a number 3 spindle, at 100 r.p.m. even at solids levels of 70% by weight, or higher, based on the total weight of the mixture. These compositions can also include amounts of conventional flow modifying materials, such as thickeners, glues, defoaming agents, salts, etc., depending upon the use intended.

The products of the invention contain only minor amounts of surfactant additives in the order of about 0.1 to 3.0 percent by weight. They further contain particulate coal as the dispersed solid in an amount from about 45 to 80 percent; water as the carrier medium in an amount of from about 19.9 to 52 percent and, if desired, from about 0.1 to 2 percent of a thickener or thickeners; about 0.01 to 2 percent of a defoaming agent and about 0.1 to 2 percent of salts, anti-bacterial agents, caustic or other additive flow control agents, all of the percentages given being based on the total weight of the mixture.

The most preferred glycol ethers of the type generally describe in formula I are the nonylphenoxy (polyethyleneoxy) ethanol compositions of the formula:

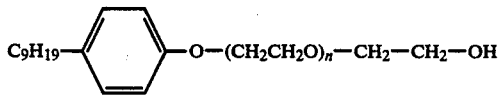

wherein n is about 100 or higher.

Commercially available surfactants of this type are supplied by the GAF Corporation under the designations IGEPAL CO-990 and IGEPAL CO-997. Other commercially available surfactants of this type are supplied by the Thompson-Hayward Chemical Co. under the designation T-Det N-100, and Whitestone Chemical Co. under the designation ICONOL NP-100.

As stated hereinbefore, another group of polyalkyleneoxide nonionic surfactants useful in the invention are the well known poly(oxyethylene)-poly(oxypropylene)-poly(oxyethylene) nonionic surfactant block polymers. These surfactants comprise the block polymers of ethylene oxide and propylene oxide with the repeating units of propylene oxide constituting the hydrophobic portion of the surfactant, and the repeating units of ethyelen oxide constituting the hydrophilic portion of the surfactant. These block polymer compositions are of the general formula II:

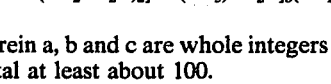

II wherein a, b and c are whole integers and wherein a and c total at least about 100.

These compositions can be prepared, and are commercially available, in a variety of molecular weights, depending primarily on the number of repeating units of propylene and ethylene oxide. It has been found that these block polymers having a molecular weight of at least about 6,000 and comprising at least about 100 repeating units of ethylene oxide are excellent additives for dispersing coal in a water carrier to the desired high coal solids concentrations of about 45 to 80 percent, preferably about 70 percent coal particles, based on the weight of the total mixture. Thus, with reference to the above formula II, the poly(oxyethylene)-poly(oxypropylene)-poly (oxyethylene) nonionic surfactants suitable for use in the invention are those wherein a, b and c are integers and a and c total about 100 or higher.

Suitable procedures for the production of the block polymers of Formula II are described in the patent literature in, for example, U.S. Pat. Nos. 2,674,619; 2,677,700 and 3,101,374, which are incorporated herein by reference.

Generally, these block polymers are prepared by a controlled addition of propylene oxide to the two hydroxyl groups of propylene glycol to form the hydrophobe, followed by the controlled addition of ethylene oxide to "sandwich" in the hydrophobe between the two hydrophilic polyethyleneoxide groups.

The nonionic surfactants of this type (Formula II) having the requisite number of at least 100 units of ethylene oxide are available from the BASF-Wyandotte Corporation under the PLURONIC designation, Series Nos. F-77, F-87, F-68, F-88, F-127, F-98, and F-108. These compositions have at least 100 ethylene oxide units, as per the following table of these PLURONIC surfactants:

| PLURONIC F | Mol. Wt. | % Ethylene Oxide | Number of Ethylene Oxide Units |
|---|---|---|---|
| F-77 | 6,600 | 70 | 105 |
| F-87 | 7,700 | 70 | 120 |
| F-68 | 8,350 | 80 | 151 |
| F-88 | 10,800 | 80 | 195 |
| F-127 | 12,500 | 70 | 200 |
| F-98 | 13,000 | 80 | 235 |
| F-108 | 14,000 | 80 | 255 |

As also described hereinbefore, a further group of polyalkyleneoxide nonionic surfactants suitable as coal dispersants herein are the nitrogen containing block polymers of the general formula III:

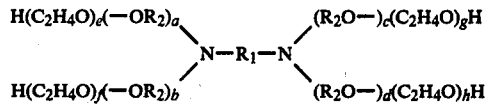

wherein $R_1$ is an alkylene radical having 2 to 5 carbon atoms, preferably 2; $R_2$ is an alkylene radical having 3 to 5 carbon atoms, preferably, 3; a, b, c, d, e, f, g and h are whole integers; and e, f, g and h total at least about 100.

These materials are prepared by the addition of a $C_3$ to $C_5$ alkylene oxide to an alkylene diamine under conditions to add two polyoxyalkylene groups to each of the nitrogen groups in the presence of a catalyst so as to polymerize the oxyalkylene groups into the desired long-chained polyoxyalkylene radicals. After the desired addition and polymerization of the $C_3$ to $C_5$ alkylene oxide group has been completed, ethylene oxide is introduced and is added to the polyoxyalkylene groups to impart the desired hydrophilic characteristics to the compound. The preparation of these materials from commercially available alkylene diamines and alkylene oxides is known in the art.

In general, the agents are prepared by mixing the $C_3$ to $C_5$ alkylene oxide with the alkylene diamine at atmospheric or elevated pressures, at temperatures between about 50° to 150° centigrade and in the presence of an alkaline catalyst such as an alkali metal hydroxide or alcoholate. The degree of polymerization or the size of the hydrophobic group is controlled by the relative proportions of $C_3$ to $C_5$ aklylene oxide and alkylene diamine, the alkylene oxide being introduced in a sufficient quantity to obtain a hydrophobic base weight of about 2000 to 3600 units although other weights can be provided.

These surfactants (Formula III) having the requisite number of at least 100 ethylene oxide repeating units are available from the BASF Wyandotte Chemicals Corporation under the TETRONIC designations Series Nos. 1107; 1307; 908 and 1508. These compositions have at least 100 ethylene oxide units, as per the following table of these TETRONIC surfactants.

| TETRONIC | Mol. Wt. | % Ethylene Oxide | Number of Ethylene Oxide Repeating Units |
|---|---|---|---|
| 1107 | 14,500 | 70 | 230 |
| 1307 | 15,500 | 70 | 245 |
| 908 | 16,500 | 80 | 300 |
| 1508 | 17,000 | 80 | 309 |

Any of a wide array of coals can be used to form the coal-aqueous mixtures of the invention, including anthracite, bituminous, sub-bituminous, mine tailings, fines, lignite and the like. Other finely divided solid carbonaceous materials may also be used, e.g., coke, prepared either from coal or from petroleum.

To form the coal-aqueous mixtures, coal is pulverized to approximately 90% finer than a 200 mesh Tyler Standard screen size, although courser or finer particle sizes can be employed, if desired.

Advantageously, according to the invention, the untreated pulverized raw coal, is beneficiated, i.e., cleaned of amounts of ash and sulfur. The art will appreciate that mixtures formed of beneficiated coal offer considerable advantage. They are clean burning or relatively clean burning, and are more suited for burning in apparatus for powering utilities, home burners and the like without undue burdensome and expensive cleaning apparatus.

Any of a wide array of beneficiating treatments can be employed in preparing the particulate coals, including conventional heavy-media separations, magnetic separation and the like. The preferred method for providing the beneficiated coal particles is by a chemical treatment process such as described in U.S. Pat. No. 4,304,573.

Generally, according to the preferred chemical beneficiation treatment method, raw as-mined coal is ground in the presence of water to a particle size of about 200 mesh. The ground coal is treated in an aqueous medium with a monomeric compound, generally an unsaturated polymerizable composition such as readily available tall oil fatty acids in the presence of a metal initiator such as cupric nitrate; and minor amounts of fuel oil, all in an aqueous phase are also present. The ground coal so treated is made hydrophobic and oleophilic and is separated from the unwanted ash and sulfur by a froth flotation technique.

The cleaned coal recovered from the preferred chemical treatment process, now in the form of beneficiated coal particles, is suited for the coal-aqueous mixtures of the invention. These coal particles are characterized by having an ash content reduced to levels of about 0.5 to 6.0% and a sulfur content reduced to levels of about 0.5 to 2.0%.

As in said U.S. Ser. No. 230,062, filed January 29, 1981, it is preferred herein to form the coal-aqueous mixtures by first adding the surfactant to water together with other additives such as conventional defoaming agents, if desired. This admixing can be done with stirring at conditions of atmospheric or nearly atmospheric temperature and pressure. Thereafter, the particulate coal, preferably beneficiated coal particles, is added to the mixture to produce a coal-aqueous mixture of high coal solids content of about 45 to 80% by weight coal, based on the total weight of the mixture at atmospheric or nearly atmospheric temperatures and pressures. If desired, thickeners can then be added to further stabilize the mixture to assist in preventing the coal particles from settling when the mixture is to be stored for extended periods. Caustic soda or other bases can also be added at this point. As will be apparent, adding thickeners in or near the final stage is preferred so that the stirring requirements are kept at a minimum. The coal-aqueous mixtures can be prepared in a batch operation or in the continuous mode. In continuous production, the coal can be admixed with water in a first stage along with other flow control agents such as the surfactant. The compositions of the first stage can then be transferred continuously to a second stage wherein the thickener is added. Again, adding the thickener at the later stage results in reduced stirring requirements.

In accordance with the discovery of the present invention, it has now been found that further specific processing conditions provide for a more improved coal-aqueous product, as well as, avoiding certain problems, such as deleterious foaming and flocculation during processing. More particularly, in preparing the coal-aqueous compositions of the present invention, the surfactant and other additives, such as conventional defoaming agents, if desired, are first added to water and mixed, under low speed agitation conditions, such as at from about 500 rpm to about 1500 rpm, preferably about 1000 rpm, for a time of from about 30 seconds to about 3 minutes, preferably about 1 minute. Thereafter, the particulate coal, preferably beneficiated coal particles, is added to the mixture and admixed therein under moderate or medium agitation conditions, for example, at an rpm in the range of from about 1000 rpm to about 3000 rpm, preferably about 2000 rpm for a time sufficient to provide a wetted out admixture. Usually this time is in the range of from about 5 minutes to about 20 minutes. At this time, the agitation of the admixture is increased to a high speed, for example, from above about 3000 rpm to about 6000 rpm, preferably about 4000 rpm for a time sufficient to disperse the coal, usually from about 5 minutes to about 15 minutes, preferably about 10 minutes. If desired, thickeners are then added to the slurry under the afore-described high speed agitation conditions, e.g. 4000 rpm, for a further time of from about 1 minute to about 3 minutes, preferably about 2 minutes. In the preparation of a most preferred formulation, other ingredients, such as viscosity stabilizers and antibacterial agents are then added to the formulation at high speed agitation for a further time of from about 1 minute to about 3 minutes, preferably about 2 minutes. By wetted out or wet as used herein, it is meant that the surface of each coal particle is covered water.

Typical mixing or dispersing apparatus employed herein include for example Premier Mill Co.'s Hi-Vispersator High-Speed Disperser.

It is to be understood that the above indicated residence times, temperatures, mixing speeds, etc. may vary according to specific process requirements such as the volume of ingredients, size of apparatus, mixing efficiency, etc. Thus, for example, depending on the scale of the operation, e.g. pilot plant, plant, etc., these process conditions of the present invention may be adjusted accordingly.

It has been found that by employing these aforedescribed specific conditions of the present invention, the coal is allowed to be dispersed in a surfactant/antifoam solution at relatively low viscosity, while the surfactant is orienting at the coal-water interface. The anti-foam agent controls the level of foam caused by the surfactant being agitated in solution. The thickeners are added after the coal is adequately dispersed to impart the desired rheological and suspension properties from flocculating by forming a protective colloid.

As indicated above, additives that can be added to the coal-aqueous mixture include defoaming agents, thickeners, salts, bases, other flow modifying agents and combinations of these materials.

Generally, the defoaming agents that can be used are conventional and include both silicon and nonsilicon containing compositions. A commercially available defoaming agent suitable for use in the mixtures is COLLOID 691, supplied by Colloids, Inc. This composition generally comprises a mixture containing mineral oil, amide and an ester.

Thickeners can also be added to the mixture. They are added to increase the non-settling characteristics of the composition. Suitable thickeners include, for example, xanthan gum, guar gum, glue and the like. Other thickeners include, for example, alkali soluble acrylic polymers (e.g. ACRYSOL ICS-1 sold by the Rohm and Haas Company). Combinations of these thickeners are also contemplated herein. For the purposes herein, the thickeners are generally used in amounts ranging from about 0.01 to about 3.0% by weight, based on the total weight of the mixture.

In preparing the compositions containing the preferred 70% by weight coal, based on the weight of the total mixture, the polyalkyleneoxide nonionic surfactants are preferably mixed with water in a proportion of about 0.3 part by weight surfactant to 29.3, parts by weight, water at atmospheric or nearly atmospheric temperatures and pressures. A defoaming agent is also added to the water in an amount of about 0.03, part by weight, to assist in processing. The pulverized coal is then mixed with the water in a proportion of 70 parts by weight coal to 29.3 parts by weight of water to obtain a flowable liquid. If desired, to the mixture can then be added about 0.12 to about 0.15, part by weight, of thickener or thickeners to provide protection against settling. Other additives such as salts or bases, antibacterial agents such as formaldehyde, and the like, viscosity stabilizers, such as ammmonia, etc. can also be added in about 0.2 to about 0.3, part by weight, of the total mixture to further assist in dispersing the coal and providing the other obvious advantages.

The following examples will further illustrate the invention:

EXAMPLE 1

Preparation of a coal-aqueous mixture

A coal-aqueous mixture using unbeneficiated particulate coal is prepared of the following composition.

| Component | Weight % |
|---|---|
| Particulate Coal[1] | 70.00 |
| Water[2] | 29.37 |
| Salt[3] | 0.60 |
| Defoaming Agent[4] | 0.30 |
| Polyethyleneoxide nonionic surfactant having 100 ethylene oxide repeating units and a molecular weight of 4680[5] | 0.57 |

[1]Pocohontas seam coal
[2]Industrial water
[3]Industrial grade sodium chloride
[4]COLLOID 691 from Colloids, Inc., Newark, N.J.
[5]IGEPAL CO-997 from the GAF Corporation, N.Y., N.Y.

The coal is ground to about 90 percent finer than 200 mesh Tyler Standard screen size. The surfactant defoaming agent, and salt in the amounts specified are added to the 29.37 grams of water in a Hi-Vispersator high-speed disperser available from the Premium Mill Co., equipped with a $1\frac{3}{4}$ inches Cowles-type blade operating at 2000 r.p.m. The disperser is operated at atmospheric temperature and pressure. The particulate coal is then added to the mixture with continued mixing.

The mixture is seen to disperse the entire 70% by weight coal and is observed to be free flowing.

EXAMPLE 2

Preparation of a coal-aqueous mixture.

A coal-aqueous mixture using another unbeneficiated particulate coal is prepared of the following composition.

| Component | Weight % |
|---|---|
| Particulate Coal[1] | 70.00 |
| Water[2] | 29.03 |
| Salt[3] | 0.60 |
| Defoaming Agent[4] | 0.30 |
| Polyethyleneoxide nonionic surfactant having 245 ethylene oxide repeating units and a molecular weight of 15,500[5] | 0.34 |

[1]Pocohontas seam coal
[2]Industrial water
[3]Industrial grade sodium chloride
[4]COLLOID 691 from Colloids, Inc., Newark, N.J.
[5]TETRONIC 1307 from BASF Wyandotte Chemicals Corp., Pasippany, N.J.

The coal is ground to about 90% finer than 200 mesh Tyler Standard screen size. The surfactant, defoaming agent, and salt in the amounts specified are added to the 29.46 grams of water in a high speed disperser equipped with a $1\frac{3}{4}$ inches Cowles-type blade operating at 2000 r.p.m. The particulate coal is then added to the mixture with continued mixing. The vessel is operated at atmospheric temperatures and pressure.

The mixture is seen to disperse the entire 70% by weight coal and is observed to be free flowing.

EXAMPLE 3

Preparation of particulate cleaned coal 200 grams of Pittsburgh seam coal having 6.3% ash content and a 1.5% sulfur content based on the weight of dry coal was pulverized in the presence of water to a 200 mesh Tyler Standard size using a ball mill grinding unit. The coal was then transferred to a mixing vessel. Into this vessel was also introduced 0.03 gram of corn oil, 5.0 grams of No. 2 fuel oil, 1.0 cubic centimeter of a 5% solution of hydrogen peroxide in water; 2.0 cubic centimeters of a 5.0% solution of cupric nitrate in water and 200 grams of the 200 mesh coal. The mixture was stirred and heated to 86° F. for 2 minutes. The mixture was sprayed into the water surface and a frothing ensued. Coal, in the froth phase, having a 3.4% ash and 0.9% sulfur based on the weight of dry coal was skimmed from the surface of the water and recovered. The water phase containing large amounts of ash and sulfur was discarded.

The recovered coal was slightly dried using a Buchner filter drying unit.

EXAMPLE 4

Preparation of a coal-aqueous mixture

Beneficiated coal, treated in accordance with the procedure of Example 3, was formed into a coal-aqueous mixture of the following composition.

| Component | Weight % |
|---|---|
| Particulate Coal[1] | 70.21 |
| Water[2] | 29.04 |
| Xanthan gum[3] | 0.06 |
| Guar gum[4] | 0.03 |
| Salt[5] | 0.06 |
| Defoaming agent[6] | 0.03 |
| Polyethyleneoxide nonionic surfactant having about 100 repeating units of ethylene oxide and a molecular weight of about 4680[7] | 0.57 |

[1]Pocohontas seam coal cleaned in accordance with the teachings of Example 3. The weight percent given being on a moisture free basis.
[2]Industrial water
[3]BIOZAN SPX-5423, Hercules Inc., Wilmington, Delaware
[4]GUAR THKX-225, Hercules Inc., Wilmington, Delaware
[5]Industrial grade sodium chloride
[6]COLLOID 691 from Colloids, Inc., Newark, N.J.
[7]IGEPAL CO-997 from the GAF Corporation, N.Y., N.Y.

The surfactant, defoaming agent and salt in the amounts specified were added to the 29.04 grams of water in a high speed disperser equipped with a 1¾ inches Cowels-type blade operated at 2000 r.p.m. The disperser was operated at atmospheric temperature and pressure. The particulate coal was then added to the mixture with continued mixing at 4500 r.p.m. To the mixture was then added the xanthan gum and guar gum thickeners with mixing at 4500 r.p.m.

The mixture was observed to disperse the entire 70.21 wt.% coal particles and was observed to be free flowing. The viscosity was measured with a Brookfield viscometer model #RVT and found to be 2000 cP at 100 r.p.m. using a #6 spindle.

EXAMPLE 5

Preparation of a coal-aqueous mixture

Beneficiated coal, treated in accordance with the procedure of Example 3, was formed into a coal-aqueous mixture of the following composition.

| Component | Weight |
|---|---|
| Particulate Coal[1] | 70.00 |
| Water[2] | 29.56 |
| Xanthum gum[3] | 0.06 |
| Guar gum[4] | 0.03 |
| Amino-hydroxy material[5] | 0.05 |
| Defoaming Agent[6] | 0.03 |
| Polyethyleneoxide nonionic surfactant having 245 repeating units of ethylene oxide and a molecular weight of about 15,500[7] | 0.30 |

[1]Pocohontas seam coal cleaned in accordance with the teachings of Example 3. The weight percent given being on a moisture free basis.
[2]Industrial water
[3]KELZAN, Kelco Co., division of Merck & Co., Inc., San Diego, California
[4]GUAR THKX-225, Hercules Inc., Wilmington, Delaware
[5]AMP-95 International Minerals & Chemical Corp., Des Plains, Illinois
[6]COLLOID 691 from Colloids, Inc., Newark, N.J.
[7]TETRONIC 1307 from BASF Wyandotte Chemicals, Corp., Parsippany, N.J.

The surfactant and defoaming agent in the amounts specified were added to the 29.56 grams of water in a high speed disperser equipped with a 1¾ inches Cowles-type blade operated at 2000 r.p.m. The disperser was operated at atmospheric temperature and pressure. The particulate coal was then added to the mixture with continued stirring at 4500 r.p.m. To the mixture was then added the xanthan gum and guar gum thickeners while mixing at 4500 r.p.m.

The mixture was observed to disperse the entire 70.00 wt. % coal particles and was observed to be free flowing. The viscosity was measured with a Brookfield viscometer model #RVT and found to be 2000 cP at 100 r.p.m. using a #6 spindle.

EXAMPLES 6–14

These examples compare mixtures which can be prepared to high coal solids concentrations utilizing polyalkyleneoxide nonionic surfactants having a high molecular weight and at least 100 repeating units of ethylene oxide with compositions which do not disperse the coal to high solid levels using similar surfactants, but which do not have the required 100 repeating units of ethylene oxide and high molecular weight.

In each example the same or substantially the same amounts of particulate coal, water, thickeners, salt and defoaming agents were used and a similar surfactant was used, i.e., a poly(oxyethylene)-poly(oxypropylene)-poly(oxyethylene) surfactant, except that the different surfactants tested had different molecular weights and a different number of ethylene oxide repeating units.

The mixtures were each prepared in accordance with the procedures of Example 4. The surfactant, defoaming agent and salt in the amount specified were added to water in a high speed disperse equipped with a 1¾ inches Cowles-type blade operated at 2000 r.p.m. The disperser was operated at atmospheric temperature and pressure. The particulate coal was then added to the mixture with continued mixing. To the mixture was then added the xanthan gum and guar gum thickeners in the stated amounts with mixing.

The following table A tabulates the results of Examples 6–14 showing that coal dispersions of high solid concentrations were prepared utilizing the poly(oxyethylene)-poly(oxypropylene)-poly(oxyethylene) surfactants having the requisite 100 repeating units of ethylene oxide and a molecular weight in excess of 6000, whereas, the same amount or substantially the same amount of coal was not fully dispersed utilizing surfactants not having the requisite 100 repeating units of ethylene oxide and high molecular weight.

TABLE A

| Components (grams) | Examples 6 | 7 | 8 | 9 | 10 | 11 | 12 | 13 | 14 | Mol. Wt. | Ethylene Oxide Repeating Units |
|---|---|---|---|---|---|---|---|---|---|---|---|
| Particulate coal[1] | 272.0 | 272.0 | 272.0 | 272.0 | 272.0 | 272.0 | 272.0 | 272.0 | 272.0 | | |
| Water[2] | 74.0 | 74.0 | 74.0 | 74.0 | 74.0 | 74.0 | 74.0 | 74.0 | 74.0 | | |
| Xanthan gum[3] | 0.2 | 0.2 | 0.2 | 0.2 | 0.2 | 0.2 | 0.2 | 0.2 | 0.2 | | |
| Guar gum[4] | 0.1 | 0.1 | 0.1 | 0.1 | 0.1 | 0.1 | 0.1 | 0.1 | 0.1 | | |
| Salt[5] | 0.2 | 0.2 | 0.2 | 0.2 | 0.2 | 0.2 | 0.2 | 0.2 | 0.2 | | |
| Defoaming Agent[6] | 0.1 | 0.1 | 0.1 | 0.1 | 0.1 | 0.1 | 0.1 | 0.1 | 0.1 | | |
| PLURONICS - L35 | 2.0 | — | — | — | — | — | — | — | — | 1,900 | 20 |
| PLURONICS - F38 | — | 2.0 | — | — | — | — | — | — | — | 5,000 | 90 |
| PLURONICS - F77 | — | — | 1.1 | — | — | — | — | — | — | 6,600 | 105 |
| PLURONICS - F87 | — | — | — | 1.1 | — | — | — | — | — | 7,700 | 120 |
| PLURONICS - F68 | — | — | — | — | 1.1 | — | — | — | — | 8,350 | 151 |
| PLURONICS - F88 | — | — | — | — | — | 1.1 | — | — | — | 10,800 | 195 |
| PLURONICS - F127 | — | — | — | — | — | — | 1.1 | — | — | 12,500 | 200 |
| PLURONICS - F98 | — | — | — | — | — | — | — | 1.1 | — | 13,000 | 235 |
| PLURONICS - F108 | — | — | — | — | — | — | — | — | 1.1 | 14,000 | 255 |
| Mixture viscosity in cP at 100 r.p.m. using a #3 spindle. | N.I. | N.I. | 5400 | 3850 | 5900 | 3800 | 3500 | 3600 | 3000 | | |

[1]Pocohontas seam coal cleaned in accordance with the teachings of Example 3 and containing 10% moisture
[2]Industrial water
[3]BIOZAN SPX-5423, Hercules Incorporated, Wilmington, Delaware
[4]GUAR THKX-225, Hercules Incorporated, Wilmington, Delaware
[5]Industrial grade sodium chloride
[6]COLLOID 691 from Colloids, Inc., Newark, N.J.
N.I. — The amount of coal specified was not fully incorporated into the water.

EXAMPLES 15–21

These examples compare mixtures which can be prepared to high coal solid concentrations utilizing polyalkyleneoxide nonionic surfactants having a high molecular weight and at least 100 repeating units of ethylene oxide with compositions which do not disperse the coal to high solid levels using similar surfactants but which do not have the required 100 repeating units of ethylene oxide and high molecular weight.

In each example the same amounts or substantially the same amounts of particulate coal, water, thickeners, salt and defoaming agents were used and a similar surfactant was used, i.e., nitrogen containing block copolymers of propylene and ethylene oxide, except that the different surfactants tested had different molecular weights and a different number of ethylene oxide repeating units.

The mixtures were each prepared in accordance with the procedures of Example 4. The surfactant, defoaming agent, and salt in the amount specified were added to water in a high speed disperser equipped with a 1¾ inches Cowles-type blade operated at 4500 r.p.m. The disperser was operated at atmospheric temperature and pressure. The particulate coal was then added to the mixture with continued mixing. To the mixture was then added the xanthan gum and guar gum thickeners in the stated amounts with mixing.

The following table B tabulates the results of Examples 15–21 showing that coal dispersions of high solid concentrations were prepared utilizing the nitrogen containing propylene and ethylene oxide block polymer surfactants having the requisite 100 repeating units of ethylene oxide and a molecular weight in excess of 14,000 whereas, the same amount of coal was not dispersed utilizing surfactants not having the requisite 100 repeating units of ethylene oxide and high molecular weight. Tetronics 1107, 1307, 908, 1508 have a higher ratio of ethylene oxide to propylene oxide, i.e. ethylene oxide content greater than propylene oxide content, while tetronics 304, 504 and 704 have a higher ratio of propylene oxide to ethylene oxide, i.e. propylene oxide content greater than ethylene oxide.

TABLE B

| Examples | 15 | 16 | 17 | 18 | 19 | 20 | 21 | Mol. Wt. | Ethylene Oxide Repeating Units |
|---|---|---|---|---|---|---|---|---|---|
| Components (grams) | | | | | | | | | |
| Particulate coal[1] | 272.0 | 272.0 | 272.0 | 272.0 | 272.0 | 272.0 | 272.0 | | |
| Water[2] | 74.0 | 74.0 | 74.0 | 74.0 | 74.0 | 74.0 | 74.0 | | |
| Xanthan gum[3] | 0.2 | 0.2 | 0.2 | 0.2 | 0.2 | 0.2 | 0.2 | | |
| Guar gum[4] | 0.1 | 0.1 | 0.1 | 0.1 | 0.1 | 0.1 | 0.1 | | |
| Salt[5] | 0.2 | 0.2 | 0.2 | 0.2 | 0.2 | 0.2 | 0.2 | | |
| Defoaming Agent[6] | 0.1 | 0.1 | 0.1 | 0.1 | 0.1 | 0.1 | 0.1 | | |
| TETRONIC - 304 | 1.3 | — | — | — | — | — | — | 1,650 | 15 |
| TETRONIC - 504 | — | 1.3 | — | — | — | — | — | 3,400 | 30 |
| TETRONIC - 704 | — | — | 1.3 | — | — | — | — | 5,500 | 50 |
| TETRONIC - 1107 | — | — | — | 1.3 | — | — | — | 14,500 | 230 |
| TETRONIC - 1307 | — | — | — | — | 1.3 | — | — | 15,500 | 245 |
| TETRONIC - 908 | — | — | — | — | — | 1.3 | — | 16,500 | 300 |
| TETRONIC - 1508 | — | — | — | — | — | — | 1.3 | 17,000 | 309 |
| Mixture viscosity in cP at 100 r.p.m. | N.I. | N.I. | N.I. | 3100 | 3700 | 3200 | 2750 | | |

TABLE B-continued

| Examples | 15 | 16 | 17 | 18 | 19 | 20 | 21 | Mol. Wt. | Ethylene Oxide Repeating Units |
|---|---|---|---|---|---|---|---|---|---|
| using a #3 spindle | | | | | | | | | |

[1]Pocohontas seam coal cleaned in accordance with the teachings of Example 3 and containing 10% moisture
[2]Industrial water
[3]BIOZAN SPX-5423, Hercules Incorporated, Wilmington, Delaware
[4]GUAR THKX-225, Hercules Incorporated, Wilmington, Delaware
[5]Industrial grade sodium chloride
[6]COLLOID 691 from Colloids, Inc., Newark, N.J.
N.I. - The amount of coal specified was not fully incorporated into the water.

EXAMPLES 22–28

These examples compare mixtures which can be prepared to high coal concentrations utilizing polyalkyleneoxide nonionic surfactants having a high molecular weight and at least 100 repeating units of ethylene oxide with compositions which do not disperse the coal to high solid levels using similar surfactants but which do not have the required 100 repeating units of ethylene oxide and high molecular weight.

In each example the same amounts or substantially the same amounts of particulate coal, water, thickeners, salt and defoaming agents were used and a similar surfactant was used, i.e., a glycol ether of an alkylated phenol, except that the different surfactants tested had different molecular weights and a different number of ethylene oxide repeating units.

The mixtures were each prepared in accordance with the procedures of Example 4. The surfactant, defoaming agent, and salt in the amount specified were added to water in a high speed disperser equipped with a $1\frac{3}{4}$ inches Cowles-type blade operated at 4500 r.p.m. The disperser was operated at atmospheric temperature and pressure. The particulate coal was then added to the mixture continued mixing. To the mixture was then added the xanthan gum and guar gum thickeners in the stated amounts with mixing.

The following table C tabulates the results of Examples 22–18 showing that coal dispersions of high solid concentrations were prepared utilizing the glycol ether of alkylated phenol surfactants having the requisite 100 repeating units of ethylene oxide and a molecular weight in excess of 4000, whereas, the same amount or substantially the same amount of coal was not fully dispersed utilizing surfactants not having the requisite 100 repeating units of ethylene oxide and high molecular weight.

TABLE C

| Examples | 22 | 23 | 24 | 25 | 26 | 27 | 28 | Mol. Wt. | Ethylene Oxide Repeating Units |
|---|---|---|---|---|---|---|---|---|---|
| Components (grams) | | | | | | | | | |
| Particulate coal[1] | 272.0 | 272.0 | 272.0 | 272.0 | 272.0 | 272.0 | 272.0 | | |
| Water[2] | 74.0 | 74.0 | 74.0 | 74.0 | 74.0 | 74.0 | 74.0 | | |
| Xanthan gum[3] | 0.2 | 0.2 | 0.2 | 0.2 | 0.2 | 0.2 | 0.2 | | |
| Guar gum[4] | 0.1 | 0.1 | 0.1 | 0.1 | 0.1 | 0.1 | 0.1 | | |
| Salt[5] | 0.2 | 0.2 | 0.2 | 0.2 | 0.2 | 0.2 | 0.2 | | |
| Defoaming Agent[6] | 0.1 | 0.1 | 0.1 | 0.1 | 0.1 | 0.1 | 0.1 | | |
| IGEPAL - CO-630 | 1.4 | — | — | — | — | — | — | 720 | 10 |
| IGEPAL - CO-730 | — | 1.4 | — | — | — | — | — | 940 | 15 |
| IGEPAL - CO-850 | — | — | 1.4 | — | — | — | — | 1,160 | 20 |
| IGEPAL - CO-887 | — | — | — | 2.0 | — | — | — | 1,600 | 30 |
| IGEPAL - CO-897 | — | — | — | — | 2.0 | — | — | 2,040 | 40 |
| IGEPAL - CO-977 | — | — | — | — | — | 2.0 | — | 2,480 | 50 |
| IGEPAL - CO-997 | — | — | — | — | — | — | 2.0 | 4,680 | 100 |
| Mixture viscosity in cP at 100 r.p.m. using a #3 spindle | N.I. | N.I. | N.I. | N.I. | N.I. | N.I. | 2000 | | |

[1]Pocohontas seam coal cleaned in accordance with the teachings of Example 3 and containing 10% moisture
[2]Industrial water
[3]BIOZAN SPX-5423, Hercules Incorporated, Wilmington, Delaware
[4]GUAR THKX-225, Hercules Incorporated, Wilmington, Delaware
[5]Industrial grade sodium chloride
[6]COLLOID 691 from Colloids, Inc., Newark, N.J.
N.I. - The amount of coal specified was not fully incorporated into the water.

As the Examples show, coal-aqueous mixtures are provided having high coal solids content. The resultant mixtures are stable, have low viscosity and incorporate large amounts of solid coal particles, typically 70% by weight coal or higher. Examples 6–14 demonstrate that polyalkylene oxide nonionic surfactants of high molecular weight of at least 6000 and having at least 100 repeating units of ethylene oxide units are excellent dispersants for forming coal-aqueous mixtures. Examples 6 to 14 further demonstrate that for the surfactants of the same basic structure, i.e., block polymers of propylene and ethylene oxide, advantageous results are achieved by employing the composition of a molecular weight of 6000 or higher having at least 100 repeating units of ethylene oxide.

Similarly, Examples 15 to 21 demonstrate that for the polyalkyleneoxide nonionic surfactants of the block polymer type derived from nitrogen containing compositions such as ethylene diamine, compositions of 14,000 molecular weight or higher having 100 repeating units of ethylene oxide provide the same or nearly the same advantageous results. Similarly, as Examples 22–28 show the glycol ether of alkylated phenol surfactants having the 100 repeating units of ethylene oxide and high molecular weight also are excellent coal dispersants.

EXAMPLE 29

The following formulation is used to prepare an aqueous coal slurry in accordance with the improvement of the present invention.

| Ingredient | Material | Parts by Weight |
|---|---|---|
| 1 | Water | 29.236 |
| 2 | Tetronic 1307 | .34 |
| 3 | Colloid 691 | .03 |
| 4 | Cleancoal | 70.00 |
| 5 | Kelzan | .014 |
| 6 | Guar THIX | .10 |
| 7 | 37% Formaldehyde | .14 |
| 8 | 28% Ammonia | .14 |
| | | 100.00 |

| | |
|---|---|
| 1. Industrial Water | |
| 2. Surfactant | BASF Wyandotte Corp. |
| 3. Anti-foam Agent | Colloids, Inc. |
| 4. Pocahontas Clean Coal | |
| 5. Xanthan Gum | Kelco Division, Merck & Co., Inc. |
| 6. Guar Gum | Hercules, Inc. |
| 7. Formaldehyde Solution | Borden Chemicals |
| 8. Ammonium Hydroxide | Fischer Scientific |

| Slurry Properties | |
|---|---|
| Solids | 70.0 ± 1.0 |
| pH | 8.0 ± 1.0 |
| Brookfield Viscosity, cp | |
| 10 rpm | 14,000 ± 4,000 |
| 100 rpm | 6,500 ± 1,500 |
| Settling (spatula probe) | |
| 6 weeks | None |
| 8 weeks | Slight amount of soft sediment |

The ingredients are added in the order listed. A high-speed disperser, namely a High-Vispersator is used to stir, mix and disperse the materials into a stable homogeneous slurry. Ingredients 1, 2 and 3 are stirred together for one minute at low speed (1,000 rpm). The coal is added to this solution at medium speed (2000 rpm) for a sufficient time to wet the coal particles and disperse the coal in ingredients 1, 2 and 3. Then the speed of the disperse is increased to high speed (4000 rpm) for 10 minutes to further disperse the coal particles. Ingredients 5 and 6 are then added with the disperser at high speed. After two minutes ingredients 7 and 8 are added and the batch is considered complete after an additional two minutes of mixing at high speed. All mixing is carried out at atmospheric temperatures and pressures.

EXAMPLE 30

The following formulation is used to prepare an aqueous coal slurry in accordance with the improvement of the present invention.

| Ingredient | Material | Parts by Weight |
|---|---|---|
| 1 | Water | 29.236 |
| 2 | Tetronic 908 | .34 |
| 3 | Colloid 691 | .03 |
| 4 | Cleancoal | 70.00 |
| 5 | Kelzan | .014 |
| 6 | Guar THIX | .10 |
| 7 | 37% Formaldehyde | .14 |
| 8 | 28% Ammonia | .14 |
| | | 100.00 |

| | |
|---|---|
| 1. Industrial Water | |
| 2. Surfactant | BASF Wyandotte Corp. |
| 3. Anti-foam Agent | Colloids, Inc. |
| 4. Pocahontas Clean Coal | |

-continued

| | |
|---|---|
| 5. Xanthan Gum | Kelco Division, Merck & Co., Inc. |
| 6. Guar Gum | Hercules, Inc. |
| 7. Formaldehyde Solution | Borden Chemicals |
| 8. Ammonium Hydroxide | Fischer Scientific |

| Slurry Properties | |
|---|---|
| Solids | 70.0 ± 1.0 |
| pH | 8.0 ± 1.0 |
| Brookfield Viscosity, cp | |
| 10 rpm | 14,000 ± 4,000 |
| 100 rpm | 6,500 ± 1,500 |
| Settling (spatula probe) | |
| 6 weeks | None |
| 8 weeks | Slight amount of soft sediment |

The ingredients are added in the order listed. A high-speed disperser, namely a High-Vispersator is used to stir, mix and disperse the materials into a stable homogeneous slurry. Ingredients 1, 2 and 3 are stirred together for one minute at low speed (1,000 rpm). The coal is added to this solution at medium speed (2,000 rpm) for a sufficient time to wet the coal particles and disperse the coal in ingredients 1, 2 and 3. Then the speed of the disperser is increased to high speed (4,000 rpm) for 10 minutes to further disperse the coal particles. Ingredients 5 and 6 are then added with the disperser at high speed. After two minutes ingredients 7 and 8 are added and the batch is considered complete after an additional two minutes of mixing at high speed. All mixing is carried out at atmospheric temperatures and pressures.

EXAMPLE 31

The following formulation is used to prepare an aqueous coal slurry in accordance with the improvement of the present invention.

| Ingredient | Material | Parts by Weight |
|---|---|---|
| 1 | Water | 29.236 |
| 2 | Tetronic 1508 | .34 |
| 3 | Colloid 691 | .03 |
| 4 | Cleancoal | 70.00 |
| 5 | Kelzan | .014 |
| 6 | Guar THIX | .10 |
| 7 | 37% Formaldehyde | .14 |
| 8 | 28% Ammonia | .14 |
| | | 100.00 |

| | |
|---|---|
| 1. Industrial Water | |
| 2. Surfactant | BASF Wyandotte Corp. |
| 3. Anti-foam Agent | Colloids, Inc. |
| 4. Pocahontas Clean Coal | |
| 5. Xanthan Gum | Kelco Division, Merck & Co., Inc. |
| 6. Guar Gum | Hercules, Inc. |
| 7. Formaldehyde Solution | Borden Chemicals |
| 8. Ammonium Hydroxide | Fischer Scientific |

| Slurry Properties | |
|---|---|
| Solids | 70.0 ± 1.0 |
| pH | 8.0 ± 1.0 |
| Brookfield Viscosity, cp | |
| 10 rpm | 14,000 ± 4,000 |
| 100 rpm | 6,500 ± 1,500 |
| Settling (spatula probe) | |
| 6 weeks | None |
| 8 weeks | Slight amount of soft sediment |

The ingredients are added in the order listed. A high-speed disperser, namely a High-Vispersator is used to stir, mix and disperse the materials into a stable homogeneous slurry. Ingredients 1, 2 and 3 are stirred together for one minute at low speed (1,000 rpm). The coal is added to this solution at medium speed (2,000 rpm) for a sufficient time to wet the coal particles and disperse the coal in ingredients 1, 2 and 3. Then the speed of the disperser is increased to high speed (4,000 rpm) for 10 minutes to further disperse the coal particles. Ingredients 5 and 6 are then added with the disperser at high speed. After two minutes ingredients 7 and 8 are added and the batch is considered complete after an additional two minutes of mixing at high speed. All mixing is carried out at atmospheric temperatures and pressures.

EXAMPLE 32

The following formulation is used to prepare an aqueous coal slurry in accordance with the improvement of the present invention.

| Ingredient | Material | Parts by Weight |
|---|---|---|
| 1 | Water | 29.236 |
| 2 | Pluronic-F-98 | .34 |
| 3 | Colloid 691 | .03 |
| 4 | Cleancoal | 70.00 |
| 5 | Kelzan | .014 |
| 6 | Guar THIX | .10 |
| 7 | 37% Formaldehyde | .14 |
| 8 | 28% Ammonia | .14 |
| | | 100.00 |

| | |
|---|---|
| 1. Industrial Water | |
| 2. Surfactant | BASF Wyandotte Corp. |
| 3. Anti-foam Agent | Colloids, Inc. |
| 4. Pocahontas Clean Coal | |
| 5. Xanthan Gum | Kelco Division, Merck & Co., Inc. |
| 6. Guar Gum | Hercules, Inc. |
| 7. Formaldehyde Solution | Borden Chemicals |
| 8. Ammonium Hydroxide | Fischer Scientific |

| Slurry Properties | |
|---|---|
| Solids | 70.0 ± 1.0 |
| pH | 8.0 ± 1.0 |
| Brookfield Viscosity, cp | |
| 10 rpm | 14,000 ± 4,000 |
| 100 rpm | 6,500 ± 1,500 |
| Settling (spatula probe) | |
| 6 weeks | None |
| 8 weeks | Slight amount of soft sediment |

The ingredients are added in the order listed. A high-speed disperser, namely a High-Vispersator is used to stir, mix and disperse the materials into a stable homogeneous slurry. Ingredients 1, 2 and 3 are stirred together for one minute at low speed (1,000 rpm). The coal is added to this solution at medium speed (2,000 rpm) for a sufficient time to wet the coal particles and disperse the coal in ingredients 1, 2 and 3. Then the speed of the disperser is increased to high speed (4,000 rpm) for 10 minutes to further disperse the coal particles. Ingredients 5 and 6 are then added with the disperser at high speed. After two minutes ingredients 7 and 8 are added and the batch is considered complete after an additional two minutes of mixing at high speed. All mixing is carried out at atmospheric temperatures and pressures.

EXAMPLE 33

The following formulation is used to prepare an aqueous coal slurry in accordance with the improvement of the present invention.

| Ingredient | Material | Parts by Weight |
|---|---|---|
| 1 | Water | 29.236 |
| 2 | Pluronic-F-108 | .34 |
| 3 | Colloid 691 | .03 |
| 4 | Cleancoal | 70.00 |
| 5 | Kelzan | .014 |
| 6 | Guar THIX | .10 |
| 7 | 37% Formaldehyde | .14 |
| 8 | 28% Ammonia | .14 |
| | | 100.00 |

| | |
|---|---|
| 1. Industrial Water | |
| 2. Surfactant | BASF Wyandotte Corp. |
| 3. Anti-foam Agent | Colloids, Inc. |
| 4. Pocahontas Clean Coal | |
| 5. Xanthan Gum | Kelco Division, Merck & Co., Inc. |
| 6. Guar Gum | Hercules, Inc. |
| 7. Formaldehyde Solution | Borden Chemicals |
| 8. Ammonium Hydroxide | Fischer Scientific |

| Slurry Properties | |
|---|---|
| Solids | 70.0 ± 1.0 |
| pH | 8.0 ± 1.0 |
| Brookfield Viscosity, cp | |
| 10 rpm | 14,000 ± 4,000 |
| 100 rpm | 6,500 ± 1,500 |
| Settling (spatula probe) | |
| 6 weeks | None |
| 8 weeks | Slight amount of soft sediment |

The ingredients are added in the order listed. A high-speed disperser, namely a High-Vispersator is used to stir, mix and disperse the materials into a stable homogeneous slurry. Ingredients 1, 2 and 3 are stirred together for one minute at low speed (1,000 rpm). The coal is added to this solution at medium speed (2,000 rpm) for a sufficient time to wet the coal particles and disperse the coal in ingredients 1, 2 and 3. Then the speed of the disperser is increased to high speed (4,000 rpm) for 10 minutes to further disperse the coal particles. Ingredients 5 and 6 are then added with the disperser at high speed. After two minutes ingredients 7 and 8 are added and the batch is considered complete after an additional two minutes of mixing at high speed. All mixing is carried out at atmospheric temperatures and pressures.

EXAMPLE 34

The following formulation is used to prepare an aqueous coal slurry in accordance with the improvement of the present invention.

| Ingredient | Material | Parts by Weight |
|---|---|---|
| 1 | Water | 29.236 |
| 2 | Pluronic-F-127 | .34 |
| 3 | Colloid 691 | .03 |
| 4 | Cleancoal | 70.00 |
| 5 | Kelzan | .014 |
| 6 | Guar THIX | .10 |
| 7 | 37% Formaldehyde | .14 |
| 8 | 28% Ammonia | .14 |
| | | 100.00 |

| | |
|---|---|
| 1. Industrial Water | |
| 2. Surfactant | BASF Wyandotte Corp. |
| 3. Anti-foam Agent | Colloids, Inc. |
| 4. Pocahontas Clean Coal | |
| 5. Xanthan Gum | Kelco Division, Merck & Co., Inc. |
| 6. Guar Gum | Hercules, Inc. |
| 7. Formaldehyde Solution | Borden Chemicals |
| 8. Ammonium Hydroxide | Fischer Scientific |

Slurry Properties

-continued

| | |
|---|---|
| Solids | 70.0 ± 1.0 |
| pH | 8.0 ± 1.0 |
| Brookfield Viscosity, cp | |
| 10 rpm | 14,000 ± 4,000 |
| 100 rpm | 6,500 ± 1,500 |
| Settling (spatula probe) | |
| 6 weeks | None |
| 8 weeks | Slight amount of soft sediment |

The ingredients are added in the order listed. A high-speed disperser, namely a High-Vispersator is used to stir, mix and disperse the materials into a stable homogeneous slurry. Ingredients 1, 2 and 3 are stirred together for one minute at low speed (1,000 rpm). The coal is added to this solution at medium speed (2,000 rpm) for a sufficient time to wet the coal particles and disperse the coal in ingredients 1, 2 and 3. Then the speed of the disperser is increased to high speed (4,000 rpm) for 10 minutes to further disperse the coal particles. Ingredients 5 and 6 are then added with the disperser at high speed. After two minutes ingredients 7 and 8 are added and the batch is considered complete after an additional two minutes of mixing at high speed. All mixing is carried out at atmospheric temperatures and pressures.

EXAMPLE 35

The following formulation is used to prepare an aqueous coal slurry in accordance with the improvement of the present invention.

| Ingredient | Material | Parts by Weight |
|---|---|---|
| 1 | Water | 29.176 |
| 2 | Igepal CO-990 | 0.40 |
| 3 | Colloid 691 | .03 |
| 4 | Cleancoal | 70.00 |
| 5 | Kelzan | .014 |
| 6 | Guar THIX | .10 |
| 7 | 37% Formaldehyde | .14 |
| 8 | 28% Ammonia | .14 |
| | | 100.00 |

| | |
|---|---|
| 1. Industrial Water | |
| 2. Surfactant | GAF Corp. |
| 3. Anti-foam Agent | Colloids, Inc. |
| 4. Pocahontas Clean Coal | |
| 5. Xanthan Gum | Kelco Division, Merck & Co., Inc. |
| 6. Guar Gum | Hercules, Inc. |
| 7. Formaldehyde Solution | Borden Chemicals |
| 8. Ammonium Hydroxide | Fischer Scientific |

| Slurry Properties | |
|---|---|
| Solids | 70.0 ± 1.0 |
| pH | 8.0 ± 1.0 |
| Brookfield Viscosity, cp | |
| 10 rpm | 14,000 ± 4,000 |
| 100 rpm | 6,500 ± 1,500 |
| Settling (spatula probe) | |
| 6 weeks | None |
| 8 weeks | Slight amount of soft sediment |

The ingredients are added in the order listed. A high-speed disperser, namely a High-Vispersator is used to stir, mix and disperse the materials into a stable homogeneous slurry. Ingredients 1, 2 and 3 are stirred together for one minute at low speed (1,000 rpm). The coal is added to this solution at medium speed (2,000 rpm) for a sufficient time to wet the coal particles and disperse the coal in ingredients 1, 2 and 3. Then the speed of the disperser is increased to high speed (4,000 rpm) for 10 minutes to further disperse the coal particles. Ingredients 5 and 6 are then added with the disperser at high speed. After two minutes ingredients 7 and 8 are added and the batch is considered complete after an additional two minutes of mixing at high speed. All mixing is carried out at atmospheric temperatures and pressures.

EXAMPLE 36

The following formulation is used to prepare an aqueous coal slurry in accordance with the improvement of the present invention.

| Ingredient | Material | Parts by Weight |
|---|---|---|
| 1 | Water | 29.176 |
| 2 | T-Det-N-100 | .40 |
| 3 | Colloid 691 | .03 |
| 4 | Cleancoal | 70.00 |
| 5 | Kelzan | .014 |
| 6 | Guar THIX | .10 |
| 7 | 37% Formaldehyde | .14 |
| 8 | 28% Ammonia | .14 |
| | | 100.00 |

| | |
|---|---|
| 1. Industrial Water | |
| 2. Surfactant | Thompson Haywood Chemical Co. |
| 3. Anti-foam Agent | Colloids, Inc. |
| 4. Pocahontas Clean Coal | |
| 5. Xanthan Gum | Kelco Division, Merck & Co., Inc. |
| 6. Guar Gum | Hercules, Inc. |
| 7. Formaldehyde Solution | Borden Chemicals |
| 8. Ammonium Hydroxide | Fischer Scientific |

| Slurry Properties | |
|---|---|
| Solids | 70.0 ± 1.0 |
| pH | 8.0 ± 1.0 |
| Brookfield Viscosity, cp | |
| 10 rpm | 14,000 ± 4,000 |
| 100 rpm | 6,500 ± 1,500 |
| Settling (spatula probe) | |
| 6 weeks | None |
| 8 weeks | Slight amount of soft sediment |

The ingredients are added in the order listed. A high-speed disperser, namely a High-Vispersator is used to stir, mix and disperse the materials into a stable homogeneous slurry. Ingredients 1, 2 and 3 are stirred together for one minute at low speed (1,000 rpm). The coal is added to this solution at medium speed (2,000 rpm) for a sufficient time to wet the coal particles and disperse the coal in ingredients 1, 2 and 3. Then the speed of the disperser is increased to high speed (4,000 rpm) for 10 minutes to further disperse the coal particles. Ingredients 5 and 6 are then added with the disperser at high speed. After two minutes ingredients 7 and 8 are added and the batch is considered complete after an additional two minutes of mixing at high speed. All mixing is carried out at atmospheric temperatures and pressures.

EXAMPLE 37

The following formulation is used to prepare an aqueous coal slurry in accordance with the improvement of the present invention.

| Ingredient | Material | Parts by Weight |
|---|---|---|
| 1 | Water | 29.176 |
| 2 | NP-100 | .40 |
| 3 | Colloid 691 | .03 |
| 4 | Cleancoal | 70.00 |
| 5 | Kelzan | .014 |
| 6 | Guar THIX | .10 |

-continued

| | | |
|---|---|---|
| 7 | 37% Formaldehyde | .14 |
| 8 | 28% Ammonia | .14 |
| | | 100.00 |

| | |
|---|---|
| 1. Industrial Water | |
| 2. Surfactant | Whitestone Chemical |
| 3. Anti-foam Agent | Colloids, Inc. |
| 4. Pocahontas Clean Coal | |
| 5. Xanthan Gum | Kelco Division, Merck & Co., Inc. |
| 6. Guar Gum | Hercules, Inc. |
| 7. Formaldehyde Solution | Borden Chemicals |
| 8. Ammonium Hydroxide | Fischer Scientific |

| Slurry Properties | |
|---|---|
| Solids | 70.0 ± 1.0 |
| pH | 8.0 ± 1.0 |
| Brookfield Viscosity, cp | |
| 10 rpm | 14,000 ± 4,000 |
| 100 rpm | 6,500 ± 1,500 |
| Settling (spatula probe) | |
| 6 weeks | None |
| 8 weeks | Slight amount of soft sediment |

The ingredients are added in the order listed. A high-speed disperser, namely a High-Vispersator is used to stir, mix and disperse the materials into a stable homogeneous slurry. Ingredients 1, 2 and 3 are stirred together for one minute at low speed (1,000 rpm). The coal is added to this solution at medium speed (2,000 rpm) for a sufficient time to wet the coal particles and disperse the coal in ingredients 1, 2 and 3. Then the speed of the disperser is increased to high speed (4,000 rpm) for 10 minutes to further disperse the coal particles. Ingredients 5 and 6 are then added with the disperser at high speed. After two minutes ingredients 7 and 8 are added and the batch is considered complete after an additional two minutes of mixing at high speed. All mixing is carried out at atmospheric temperatures and pressures.

EXAMPLE 38

The following formulation is used to prepare an aqueous coal slurry in accordance with the improvement of the present invention.

| Ingredient | Material | Parts by Weight |
|---|---|---|
| 1 | Water | 29.176 |
| 2 | Tetronic 908 | .40 |
| 3 | Colloid 691 | .03 |
| 4 | Coal(non-beneficiated) | 70.00 |
| 5 | Kelzan | .014 |
| 6 | Guar THIX | .10 |
| 7 | 37% Formaldehyde | .14 |
| 8 | 28% Ammonia | .14 |
| | | 100.00 |

| | |
|---|---|
| 1. Industrial Water | |
| 2. Surfactant | BASF Wyandotte Corp. |
| 3. Anti-foam Agent | Colloids, Inc. |
| 4. Pocahontas Coal | |
| 5. Xanthan Gum | Kelco Division, Merck & Co., Inc. |
| 6. Guar Gum | Hercules, Inc. |
| 7. Formaldehyde Solution | Borden Chemicals |
| 8. Ammonium Hydroxide | Fischer Scientific |

| Slurry Properties | |
|---|---|
| Solids | 70.0 ± 1.0 |
| pH | 8.0 ± 1.0 |
| Brookfield Viscosity, cp | |
| 10 rpm | 14,000 ± 4,000 |
| 100 rpm | 6,500 ± 1,500 |
| Settling (spatula probe) | |
| 6 weeks | None |

-continued

| | |
|---|---|
| 8 weeks | Slight amount of soft sediment |

The ingredients are added in the order listed. A high-speed disperser, namely a High-Vispersator is used to stir, mix and disperse the materials into a stable homogeneous slurry. Ingredients 1, 2 and 3 are stirred together for one minute at low speed (1,000 rpm). The coal is added to this solution at medium speed (2,000 rpm) for a sufficient time to wet the coal particles and disperse the coal in ingredients 1, 2 and 3. Then the speed of the disperser is increased to high speed (4,000 rpm) for 10 minutes to further disperse the coal particles. Ingredients 5 and 6 are then added with the disperser at high speed. After two minutes ingredients 7 and 8 are added and the batch is considered complete after an additional two minutes of mixing at high speed. All mixing is carried out at atmospheric temperatures and pressures.

From the foregoing it will be seen that coal-aqueous mixtures are readily provided having significantly high solid concentrations. The mixtures can be provided in a clean form ready for burning in utility burners, home burners and the like with little if any need for additional cleaning to remove ash and sulfur.

Thus, while an embodiment of the foregoing invention has been described, it is to be understood this description is offered by way of illustration only. The range of adaptability of the process presented herein is contemplated to include many variations and adaptations of the subject matter within the scope of the production of coal-aqueous mixtures. And it is to be understood that this invention is to be limited only by the scope of the appended claims.

What is claimed is:

1. A method for forming a coal-aqueous mixture, said method comprising the steps of:

(i) admixing a polyalkyleneoxide nonionic surfactant having a hydrophobic portion and a hydrophilic portion, said hydrophilic portion being comprised of at least about 100 units of ethylene oxide, with water, under low speed agitation conditions;

(ii) admixing particulate coal with the admixture resulting from step (i) under medium speed agitation conditions; and (iii) agitating the resultant coal containing mixture of step (ii) under high speed agitation.

2. The method of claim 1 wherein said medium speed agitation in step (ii) is carried out for a time sufficient to wet the coal particles and said high speed agitation is carried out for a time sufficient to disperse the coal.

3. The method of claim 1 wherein an anti-foam agent is added to the mixture during step (i).

4. The method of claim 1 including the further steps of:

(iv) admixing a thickening agent under high speed agitation conditions, to the admixture resulting from step (iii).

5. The method of claim 4, wherein said thickening agent is selected from the group consisting of xanthan gum, guar gum, cellulose gum, glue and alkali soluble acrylic polymer.

6. The method of claim 2 wherein said anti-foam agent is comprised a mixture of mineral oil, amide and polyethylene glycol oleate ester.

7. The method of claim 4 including the further step of:

(v) admixing, a member selected from the group consisting of an anti-bacterial agent, a viscosity stabilizer and mixtures thereof to the mixture resulting from step (iv), under high speed agitation.

8. The method of claim 7 wherein said viscosity stabilizer is ammonia.

9. The method of claim 1 wherein said particulate coal is added in an amount from about 45 to 80 percent; said water is added in an amount from about 19.9 to 52 percent; and said polyalkyleneoxide nonionic surfactant is added in an amount from about 0.1 to 3.0 percent, based on the total weight of the mixture.

10. The method of claim 1 wherein said polyalkyleneoxide nonionic surfactant has a molecular weight of at least about 4000.

11. The method of claim 1 wherein said polyalkyleneoxide nonionic surfactant comprises a composition of the formula

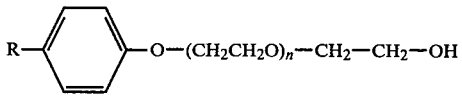

wherein R is substituted or unsubstituted alkyl of from 1 to 18 carbon atoms; substituted or unsubstituted aryl or an amino group, and n is an integer of at least about 100.

12. The method of claim 11 wherein R is a nonyl.

13. The method of claim 11 wherein said polyalkyleneoxide nonionic surfactant has a molecular weight of at least about 4000.

14. The method of claim 1 wherein said polyalkyleneoxide nonionic surfactant comprises a composition of the formula $$HO(CH_2CH_2O)_a[CH(CH_3)CH_2O]_b(CH_2CH_2O)_cH$$

wherein a, b and c are whole integers and a and c total at least about 100.

15. The method of claim 14 wherein said polyalkyleneoxide nonionic surfactant has a molecular weight of at least about 6000.

16. The method of claim 1 wherein said polyalkyleneoxide nonionic surfactant comprises a composition of the formula

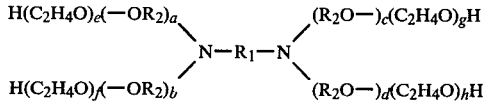

wherein $R_1$ is an alkylene radical having 2 to 5 carbon atoms; $R_2$ is an alkylene radical having 3 to 5 carbon atoms; a, b, c, d, e, f, g and h are whole integers and e, f, g and h total at least about 100.

17. The method as defined in claim 16 wherein $R_1$ is an alkylene radical having 2 carbon atoms and $R_2$ is an alkylene radical having 3 carbon atoms.

18. The method of claim 4 where said thickening agent is added in an amount to result in from about 0.01 to 3 percent by weight of the total mixture.

19. The method of claim 1 wherein said particulate coal is beneficiated.

20. The method of claim 1 wherein said particulate coal is about 200 mesh in Tyler Standard screen size.

21. The method of claim 1 wherein said particulate coal is characterized by having a sulfur content of from 0.5 to 2.0 percent by weight, and an ash content of from about 0.5 to 6.0 percent, based on the weight of dry coal.

22. The method of claim 21 wherein said particulate coal further includes a fuel oil.

23. The method of claim 1 wherein said particulate coal is non-beneficiated.

* * * * *

UNITED STATES PATENT AND TRADEMARK OFFICE

CERTIFICATE OF CORRECTION

PATENT NO. : 4,441,889

DATED : April 10, 1984

INVENTOR(S) : Seymour Mark

It is certified that error appears in the above identified patent and that said Letters Patent is hereby corrected as shown below:

Column 1, line 17, "avaiable" should read --available--;

Column 1, line 17, "then" should read --than--;

Column 4, line 26, "valve" should read --value--;

Column 4, line 65, "$HO(CH_2CH_2O)_a]CH(CH_3)CH_2O]_b(CH_2CH_2O)_cH$" should read --$HO(CH_2CH_2O)_a[CH(CH_3)CH_2O]_b(CH_2CH_2O)_cH$--;

Column 5, line 66, "ethyelen oxide" should read --ethylene oxide--;

Column 7, line 17, "aklylene oxide" should read --alkylene oxide--.

Column 10, line 50, "0.30" should read --0.03--;

UNITED STATES PATENT OFFICE

CERTIFICATE OF CORRECTION

Patent No. 4,441,889 Dated April 10, 1984

Inventor(s) Seymour Mark

It is certified that error appears in the above-identified patent and that said Letters Patent are hereby corrected as shown below:

Column 12, line 6, "xanthum gum" should read --xanthan gum--;

Column 12, line 9, "having 245 repeating" should read --having about 245 repeating--;

Column 12, line 54, "disperse" should read --disperser--;

Column 13, line 43, "copolymers" should read --polymers--;

Column 15, line 63, "22-18" should read --22-28--.

Signed and Sealed this

*Eleventh* Day of *December 1984*

[SEAL]

*Attest:*

GERALD J. MOSSINGHOFF

*Attesting Officer* *Commissioner of Patents and Trademarks*